US007378931B2

(12) United States Patent
Odahara et al.

(10) Patent No.: US 7,378,931 B2
(45) Date of Patent: May 27, 2008

(54) MULTILAYER COIL COMPONENT

(75) Inventors: Mitsuru Odahara, Yasu (JP); Tomoyuki Maeda, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/844,483

(22) Filed: Aug. 24, 2007

(65) Prior Publication Data

US 2007/0296536 A1 Dec. 27, 2007

Related U.S. Application Data

(63) Continuation of application No. PCT/JP2006/317426, filed on Sep. 4, 2006.

(30) Foreign Application Priority Data

Sep. 29, 2005 (JP) ..... 2005-284560

(51) Int. Cl.
*H01F 5/00* (2006.01)

(52) U.S. Cl. ..... 336/200

(58) Field of Classification Search ..... 336/65, 336/83, 200, 206–208, 232; 257/531
See application file for complete search history.

(56) References Cited

U.S. PATENT DOCUMENTS 6,008,151 A * 12/1999 Sasaki et al. ..... 501/17
6,498,553 B1 * 12/2002 Tanaka et al. ..... 336/83

FOREIGN PATENT DOCUMENTS

| | | | |
|---|---|---|---|
| JP | 06053044 A | * | 2/1994 |
| JP | 08-138940 A | | 5/1996 |
| JP | 2000-138120 A | | 5/2000 |
| JP | 3039538 B1 | | 5/2000 |
| JP | 2001060519 A | * | 3/2001 |
| JP | 2001093735 A | * | 4/2001 |
| JP | 2001-176725 A | | 6/2001 |
| JP | 2001-210522 A | | 8/2001 |
| JP | 2002-134322 A | | 5/2002 |

OTHER PUBLICATIONS

Official Communication for PCT Application No. PCT/JP2006/317426; mailed Dec. 5, 2006.

* cited by examiner

*Primary Examiner*—Tuyen T. Nguyen
(74) *Attorney, Agent, or Firm*—Keating & Bennett, LLP

(57) ABSTRACT

A multilayer coil component is formed such that ceramic green sheets having coil conductors and via hole conductors are laminated. The multilayer coil component includes therein a spiral coil in which the coil conductors are connected in series through the via hole conductors. In plan view in a lamination direction, the via hole conductors are located in positions spaced toward the outer side of the spiral coil, the positions being located near end surfaces in a long side direction of a multilayer body.

14 Claims, 7 Drawing Sheets

MULTILAYER COIL COMPONENT

BACKGROUND OF THE INVENTION

1. Field of the Invention

The present invention relates to multilayer coil components, and more particularly to a multilayer coil component having a multilayer body made of a plurality of ceramic layers and a spiral coil provided in the multilayer body.

2. Description of the Related Art

For example, a configuration disclosed in Japanese Unexamined Patent Application Publication No. 2001-176725 is a known multilayer coil component. As shown in FIG. 7A, a multilayer coil component 71 is formed such that ceramic sheets 72*a* to 72*f* having coil conductors 73*a* to 73*f* and via hole conductors 76*a* to 76*e* are laminated in the order from the sheet 72*a* to the sheet 72*f*, and then protection ceramic green sheets (not shown) are laminated on the upper and lower sides of the laminated sheets 72*a* to 72*f*. The coil conductors 73*a* to 73*f* are connected in series through the via hole conductors 76*a* to 76*e*, to define a spiral coil 73. Reference numerals 74*a* to 74*j* denote pads provided at end portions of the coil conductors 73*a* to 73*f*. FIG. 7B is a perspective plan view showing the multilayer coil component 71.

FIGS. 8A and 8B are an exploded plan view and a perspective plan view each showing a multilayer coil component 81 in which the inner periphery of the coil conductors 73*a* to 73*f* has a curved profile. Like components are denoted by like numerals as shown in FIGS. 7A and 7B.

Unfortunately, in the multilayer coil components 71 and 81, the pads 74*a* to 74*j* and the via hole conductors 76*a* to 76*e* are located in positions spaced toward the inner side of the spiral coil 73 in plan view in a lamination direction. This is for done to reliably provide side gaps. Accordingly, the inside diameter of the spiral coil 73 becomes small, resulting in reduction in inductance. Also, in plan view, since the pads 74*a* to 74*j* and the via hole conductors 76*a* to 76*e* are superposed on the coil conductors 73*a* to 73*f*, a large pressure may be applied to the pads 74*a* to 74*j* and the via hole conductors 76*a* to 76*e* during a contact bonding procedure after the lamination. Accordingly, the pads 74*a* to 74*j* and the via hole conductors 76*a* to 76*e* may be flattened, and thus the inside diameter of the coil 73 may become further small. In addition, a stress may be concentrated at the pads 74*a* to 74*j* and the via hole conductors 76*a* to 76*e*, and thus the inductance may be reduced.

SUMMARY OF THE INVENTION

In order to overcome the problems described above, preferred embodiments of the present invention provide a multilayer coil component in which a reduction in inductance is small.

A multilayer coil component according to a preferred embodiment of the present invention includes a multilayer body in which a plurality of coil conductors and a plurality of ceramic layers are laminated; and a spiral coil in which the plurality of coil conductors are connected in series through a plurality of via hole conductors provided at end portions of the coil conductors. In the multilayer coil component, in plan view in a lamination direction, a center of at least one of the via hole conductors is located at a position spaced toward an outer side of the spiral coil with respect to a center in a coil-conductor-width direction. In addition, a pattern of an end portion of a corresponding one of the coil conductors that is connected to the via hole conductor with the center thereof located in the position spaced toward the outer side of the spiral coil with respect to the center in the coil-conductor-width direction is different from a pattern of another one of the coil conductors that is not connected to the via hole conductor and located in a coil axis direction of the spiral coil with respect to the end portion of the corresponding one of the coil conductors. Further, a portion of the via hole conductor with the center thereof located in the position spaced toward the outer side of the spiral coil with respect to the center in the coil-conductor-width direction is located outside an outer peripheral surface of the spiral coil.

With the multilayer coil component according to the present preferred embodiment of the present invention, since the center of the at least one of the via hole conductors is located in the position spaced toward the outer side of the spiral coil with respect to the center in the coil-conductor-width direction, the inside diameter of the spiral coil becomes large and is prevented from becoming small since the via hole conductors are not flattened. Thus, a reduction in inductance is reliably prevented. In addition, in plan view in the lamination direction, since the overlap amount between the via hole conductor and the coil conductor is reduced, and the conductors are prevented from being concentrated (stress concentration), decreases in inductance and lamination shifts are prevented.

In the multilayer coil component according to the present preferred embodiment of the present invention, in plan view in the lamination direction, the center of the via hole conductor may be located at a position near an end surface in a long side direction of the multilayer body with respect to the center in the coil-conductor-width direction. Accordingly, side gaps in a short side direction of the multilayer body may be reliably provided between the coil conductors and the end surface of the multilayer body.

Also, a multilayer coil component according to a second preferred embodiment of the present invention includes a multilayer body in which a plurality of coil conductors and a plurality of ceramic layers are laminated; and a spiral coil in which the plurality of coil conductors are connected in series through pads and via hole conductors provided at end portions of the coil conductors. In the multilayer coil component, in plan view in a lamination direction, a center of at least one of the via hole conductors and a center of at least one of the pads are located in positions spaced toward an outer side of the spiral coil with respect to a center in a coil-conductor-width direction. In addition, a pattern of an end portion of a corresponding one of the coil conductors that is connected to the via hole conductor with the center thereof located in the position spaced toward the outer side of the spiral coil with respect to the center in the coil-conductor-width direction is different from a pattern of another one of the coil conductors that is not connected to the via hole conductor and located in a coil axis direction of the spiral coil with respect to the end portion of the corresponding one of the coil conductors.

With the multilayer coil component according to the present preferred embodiment, since the center of the at least one of the via hole conductors and the center of the at least one of the pads are located in the positions spaced toward the outer side of the spiral coil with respect to the center in the coil-conductor-width direction, the inside diameter of the spiral coil becomes large and is prevented from becoming small by way of the pad. Thus, the reduction in inductance is prevented. Also, the via hole conductor is large.

In the multilayer coil component according to the present preferred embodiment, a portion of the via hole conductor with the center thereof located in the position spaced toward the outer side of the spiral coil with respect to the center in the coil-conductor-width direction may be preferably located outside an outer peripheral surface of the spiral coil. Accordingly, the overlap amount between the via hole conductor and the coil conductor is reduced, and the inside diameter of the coil is prevented from becoming small since the via hole conductor is not flattened, and the stress concentration is reduced. This reliably prevents decreases in inductance and lamination shifts. In addition, in plan view in the lamination direction, the center of the via hole conductor and the center of the pad located in the positions spaced toward the outer side of the spiral coil with respect to the center in the coil-conductor-width direction may be located in positions near an end surface in a long side direction of the multilayer body with respect to the center in the coil-conductor-width direction. Accordingly, side gaps in a short side direction of the multilayer body are reliably provided between the conductors and the end surface of the multilayer body.

In each of the multilayer coil components according to the above-described preferred embodiments, the entire via hole conductor with the center thereof located at the position spaced toward the outer side of the spiral coil with respect to the center in the coil-conductor-width direction may be preferably located outside an outer peripheral surface of the spiral coil. Accordingly, the overlap amount in the lamination direction between the via hole conductor and the coil conductor is minimized, thereby effectively preventing the concentration of the conductors, and also, the inside diameter of the spiral coil becomes large, thereby increasing the inductance.

Further, in a case where the coil conductors each have a ¾ turn profile, then the locations of the via hole conductors may be distributed to four positions, for example, thereby further enhancing the effect for preventing the concentration of the conductors. Also, at least the inner periphery of the coil conductors preferably has a curved profile. Although the direct-current resistance thereof becomes large if the spiral coil has a rectangular periphery, the direct-current resistance becomes small if the coil conductor has a curved profile. Alternatively, in plan view in the lamination direction, the via hole conductors are preferably arranged in a staggered manner. This arrangement may prevent a short-circuit from occurring between the via hole conductors.

With preferred embodiments of the present invention, the center of the at least one of the via hole conductors and the center of the at least one of the pads are located in the positions spaced toward the outer side of the spiral coil with respect to the center in the coil-conductor-width direction. Accordingly, the inside diameter of the spiral coil may be increased, thereby preventing reduction in inductance. Further, in plan view in the lamination direction, since the overlap amount between the coil conductor and the via hole conductor with the pad is reduced, the conductors are prevented from being concentrated, thus the stress concentration is reduced, and decreases in inductance and lamination shifts are prevented.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 1A and 1B illustrate a first preferred embodiment of a multilayer coil component according to the present invention, in which FIG. 1A is an exploded plan view, and FIG. 1B is a perspective plan view.

FIGS. 3A and 3B illustrate a second preferred embodiment of a multilayer coil component according to the present invention, in which FIG. 3A is an exploded plan view, and FIG. 3B is a perspective plan view.

FIGS. 4A and 4B illustrate a third preferred embodiment of a multilayer coil component according to the present invention, in which FIG. 4A is an exploded plan view, and FIG. 4B is a perspective plan view.

FIGS. 5A and 5B illustrate a modification of a preferred embodiment of the present invention, in which FIG. 5A is an exploded plan view, and FIG. 5B is a perspective plan view.

FIGS. 6A and 6B illustrate another modification of a preferred embodiment of the present invention, in which FIG. 6A is an exploded plan view, and FIG. 6B is a perspective plan view.

FIGS. 7A and 7B illustrate a first conventional example, in which FIG. 7A is an exploded plan view, and FIG. 7B is a perspective plan view.

FIGS. 8A and 8B illustrate a second conventional example, in which FIG. 8A is an exploded plan view, and FIG. 8B is a perspective plan view.

DETAILED DESCRIPTION OF PREFERRED EMBODIMENTS

Preferred embodiments of a multilayer coil component according to the present invention are described below with reference to the attached drawings.

First Preferred Embodiment

Figure 1A:
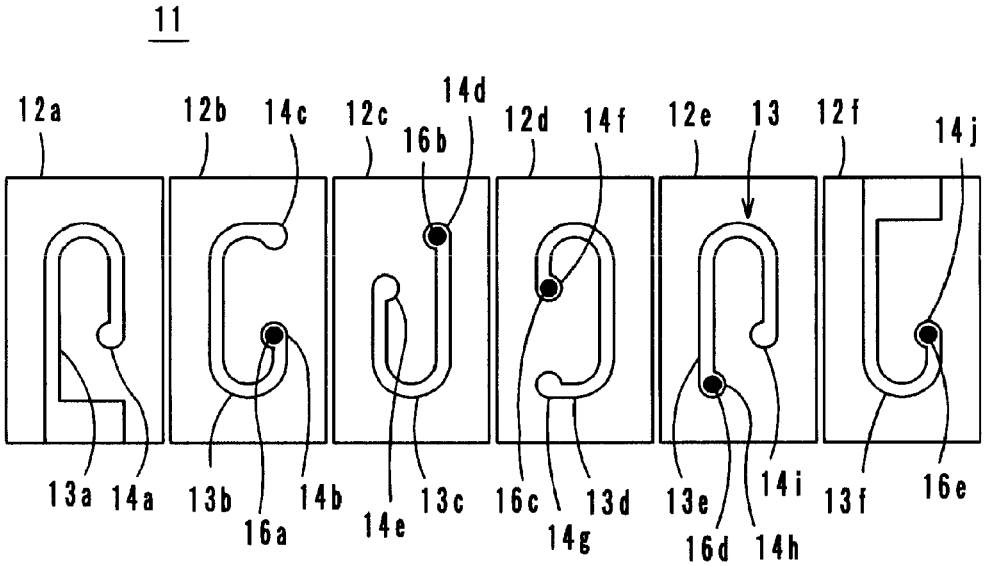
Figure 1B:
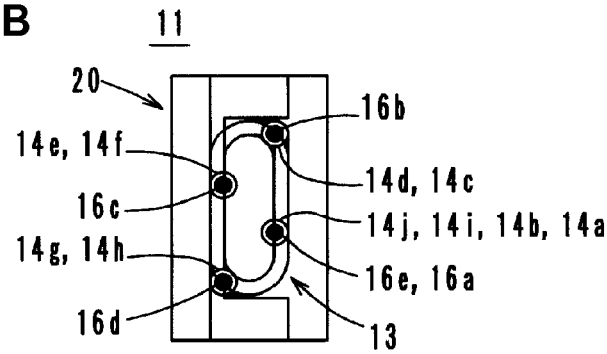
Figure 2:
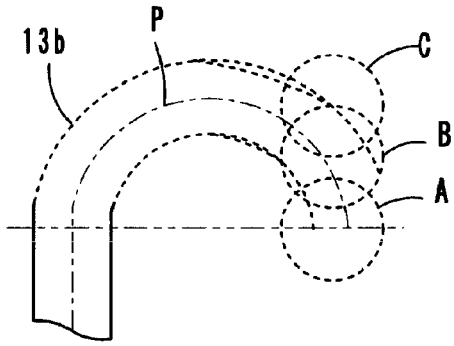
FIG. 2 is a partially enlarged plan view showing a positional relationship between a coil conductor and a pad.

FIGS. 1A, 1B and 2

FIG. 1A is an exploded plan view showing a multilayer coil component 11, and FIG. 1B is a perspective plan view showing the multilayer coil component 11. As shown in FIGS. 1A and 1B, the multilayer coil component 11 is formed such that ceramic green sheets 12*a* to 12*f* having coil conductors 13*a* to 13*f* and via hole conductors 16*a* to 16*e* are laminated in the order from the sheet 12*a* to the sheet 12*f*, and then protection ceramic green sheets (not shown) are laminated on the upper and lower sides of the laminated sheets 12*a* to 12*f*.

The ceramic green sheets 12*a* to 12*f* are preferably manufactured as follows. First, iron oxide powder, nickel oxide powder, copper oxide powder, zinc oxide powder, and other suitable material, are weighed so as to be a predetermined ratio, wet-blended and dried, and then calcined in a tunnel furnace. The calcined powder is pre-grinded to be a ceramic material.

Next, pure water, a dispersing agent, and the ceramic material are wet-blended, and wet-grinded by using a ball mill to obtain a desired particle size or a desired specific surface. A binder, a plasticizer, a wetting agent, an antifoaming agent, and the like, are added to the obtained solution. The resultant is wet-blended by a predetermined period of time, and degassed in vacuum, to obtain ceramic slurry. The ceramic slurry is formed in a sheet-like form by the doctor blade method or the like to have a predetermined thickness.

Next, holes for via hole conductors are formed by irradiating predetermined positions of the ceramic green sheets 12*b* to 12*f* with a laser or the like. Then Ag paste is provided on the ceramic green sheets 12*a* to 12*f* by screen printing to form the coil conductors 13*a* to 13*f*. At the same time, the holes for via hole conductors are filled with the Ag paste to form the via hole conductors 16*a* to 16*e*. Reference numerals 14*a* to 14*j* denote pads which are concurrently formed using the Ag paste. Note that a pad is a conductive portion arranged at an end portion of the coil conductor and having a width larger than a conductor width of the coil conductor.

Next, the ceramic green sheets 12*a* to 12*f* and the protection ceramic green sheets are laminated to form a multilayer body 20. The multilayer body 20 is cut into pieces having a predetermined size, and the pieces are fired at a predetermined temperature for a predetermined period of time. Then, conductive paste is applied by dipping end surfaces where lead portions of the coil conductors 13*a* and 13*f* are exposed, so as to form outer electrodes.

The multilayer coil component 11 thus obtained has therein a spiral coil 13 which is defined such that the coil conductors 13*a* to 13*f* are electrically connected in series through the pads 14*a* to 14*j* and the via hole conductors 16*a* to 16*e* arranged at the end portions of the coil conductors 13*a* to 13*f*. Since the pads 14*a* to 14*j* are provided, the via hole conductors 16*a* to 16*e* become large, thereby providing reliable electric connection in the coil conductors 13*a* to 13*f*. At least the inner periphery of the spiral coil 13 has a curved profile.

As shown in FIG. 1B, as seen in plan view in a lamination direction, the center of the via hole conductor 16*b* and pads 14*c* and 14*d*, and the center of the via hole conductor 16*d* and pads 14*g* and 14*h*, are located at positions spaced toward the outer side of the spiral coil 13 with respect to the center in a coil-conductor-width direction. Note that the position spaced toward the outer side is a position located outside the center in the coil-conductor-width direction as seen in plan view. In particular, the center of the via hole conductor 16*b* and pads 14*c* and 14*d* is located in the position spaced toward the outer side with respect to the center in the coil-conductor-width direction of the coil conductors 13*a*, and 13*d* to 13*f* which do not contain the via hole conductor 16*b* or pads 14*c* and 14*d*. Also, the center of the via hole conductor 16*d* and pads 14*g* and 14*h* is located in the position spaced toward the outer side with respect to the center in the coil-conductor-width direction of the coil conductors 13*a* to 13*c*, and 13*f* which do not contain the via hole conductor 16*d* or pads 14*g* and 14*h*. To be more specific, the position spaced toward the outer side is a position near an end surface in a long side direction of the multilayer body 20. Accordingly, side gaps in a short side direction of the multilayer coil component 11 are reliably provided.

In contrast, the center of the via hole conductor 16*c* and pads 14*e* and 14*f*, and the center of the via hole conductors 16*a* and 16*e* and pads 14*a*, 14*b*, 14*i*, and 14*j*, are located at positions spaced toward the inner side of the spiral coil 13 with respect to the center in the coil-conductor-width direction. Such an arrangement reliably provides the above-mentioned side gaps.

A pattern of the end portions of the coil conductors 13*b* to 13*e* connected to the via hole conductors 16*b* and 16*d* is different from a pattern of the coil conductors 13*a* to 13*f* located in a coil axis direction of the spiral coil 13 with respect to the end portions of the coil conductors 13*b* to 13*e*. In particular, the pattern of the end portions of the coil conductors 13*b* and 13*c* connected to the via hole conductor 16*b* has a substantially rectangular profile in the vicinity of the via hole conductor 16*b*. On the other hand, the pattern of the coil conductors 13*d* and 13*e* located in the coil axis direction of the spiral coil 13 with respect to the end portions of the coil conductors 13*b* and 13*c* preferably has a circular or substantially circular profile. As seen in plan view, since the pattern of the coil conductors 13*d* and 13*e* is different from that of the coil conductors 13*b* and 13*c* in the vicinity of the via hole conductor 16*b*, the center of the via hole conductor 16*b* may be located in the position spaced toward the outer side of the spiral coil 13 with respect to the center in the coil-conductor-width direction. Similarly, a pattern of the end portions of the coil conductors 13*d* and 13*e* connected to the via hole conductor 16*d* preferably has a substantially rectangular profile in the vicinity of the via hole conductor 16*d*. On the other hand, a pattern of the coil conductors 13*b* and 13*c* located in the coil axis direction of the spiral coil 13 with respect to the end portions of the coil conductors 13*d* and 13*e* preferably has a circular or substantially circular profile. As seen in plan view, since the pattern of the coil conductors 13*b* and 13*c* is different from that of the coil conductors 13*d* and 13*e* in the vicinity of the via hole conductor 16*d*, the center of the via hole conductor 16*d* may be located in the position spaced toward the outer side of the spiral coil 13 with respect to the center in the coil-conductor-width direction.

A portion of each of the via hole conductors 16*b* and 16*d* is located outside an outer peripheral surface of the spiral coil 13. Note that, in plan view, the outer peripheral surface is an outer peripheral surface of the spiral coil 13 defined by the other coil conductors which are not connected to the corresponding via hole conductors. In particular, an outer peripheral surface of the spiral coil 13 defined by the coil conductors 13*a*, and 13*d* to 13*f* is assigned to the case of the via hole conductor 16*b*, whereas an outer peripheral surface of the spiral coil 13 defined by the coil conductors 13*a* to 13*c*, and 13*f* is assigned to the case of the via hole conductor 16*d*.

Figure 8A:
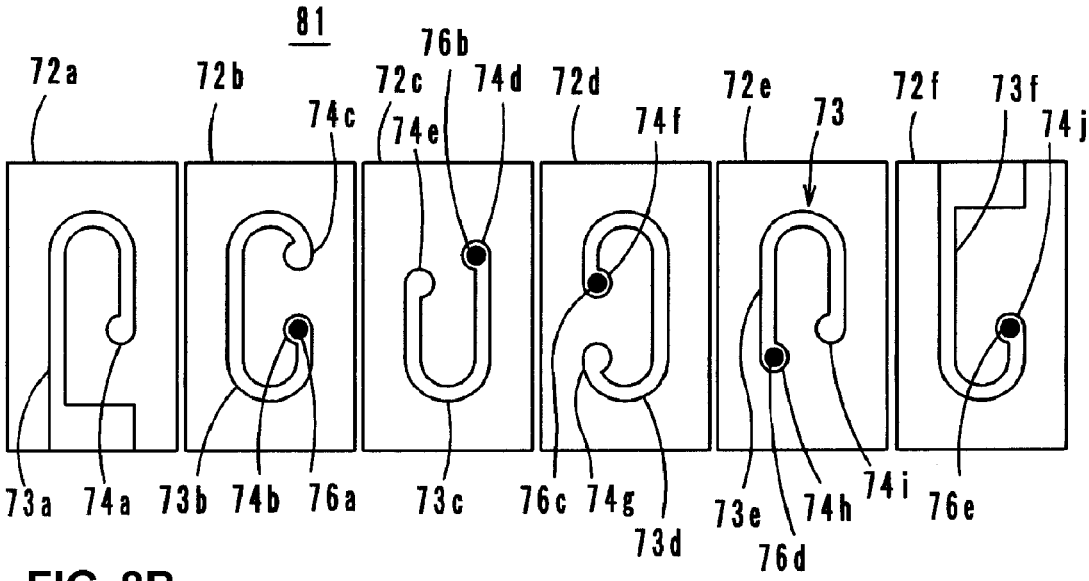
FIG. 8A Prior Art
Figure 8B:
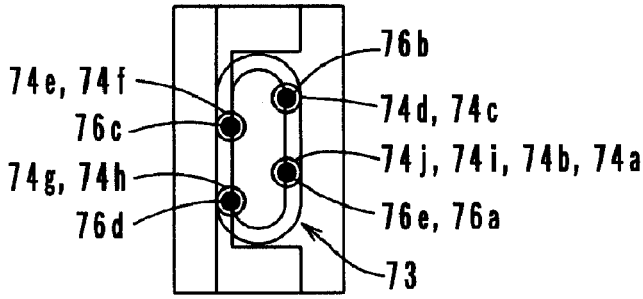
FIG. 8B Prior Art

The positions of the pads 14*c* and 14*d* (14*g* and 14*h*) are described in detail. FIG. 2 shows circles A, B and C indicated by dotted lines. The known multilayer coil component 81 shown in FIGS. 8A and 8B has a pad in a position indicated by the circle A. That is, this pad is located in a position spaced toward the inner side of the spiral coil with respect to the center in the coil-conductor-width direction.

In contrast, the multilayer coil component 11 has the pads 14*c* and 14*d* in a position indicated by the circle C. That is, the pads 14*c* and 14*d* are located in the position spaced toward the outer side of the spiral coil 13 with respect to a center line P in the coil-conductor-width direction of the coil conductor 13*b*. To be more specific, the center of the circle C is shifted from the center of the circle A by a distance ranging from about 65 μm to about 79 μm (before firing), for example. Only a substantially half portion of each of the pads 14*c* and 14*d* is superposed on the coil conductor 13*b* in plan view. In this case, the diameter of the pads 14*c* and 14*d* is preferably about 80 μm, for example, and the conductor width of the coil conductor 13*b* is preferably about 50 μm, for example.

Accordingly, by shifting the center of the pads 14*c* and 14*d* to the position spaced toward the outer side of the spiral coil 13 with respect to the position of the circle B which is located on the center line P in the coil-conductor-width direction of the coil conductor 13*b*, the inside diameter of the spiral coil 13 may be prevented from becoming small. As a result, the inside diameter of the spiral coil 13 is large, thereby preventing the reduction in inductance. If the shift distance is increased, then the overlap amount between the coil conductor 13*b*, and the via hole conductor 16*b* with the pads 14*c* and 14*d* becomes small in plan view, thereby preventing the conductors from being concentrated. This prevents stress concentration and lamination shift.

Table 1 shows the evaluation results of the multilayer coil component 11. Table 1 also shows the evaluation results of the known multilayer coil components 71 and 81 for comparison. Note that "acquisition efficiency" written in the table represents (impedance at 100 MHz)/(direct-current resistance). The configuration is preferable as this value is large.

TABLE 1

| | Impedance (100 MHz) Ω | Direct-current resistance Ω | Acquisition efficiency | Lamination shift in width direction μm |
|---|---|---|---|---|
| Comparative Example 1 (multilayer coil component 71) | 240 | 0.360 | 667 | 7.8 |
| Comparative Example 2 (multilayer coil component 81) | 222 | 0.326 | 681 | 7.5 |
| First embodiment (multilayer coil component 11) | 238 | 0.330 | 721 | 3.2 |

As shown in Table 1, in Comparative Example 1 (the known multilayer coil component 71), a spiral coil 73 has a rectangular profile. Accordingly, electric current is concentrated at corner portions of coil conductors, and hence, the direct-current resistance becomes large. In Comparative Example 2 (the known multilayer coil component 81), a spiral coil 73 has a circular profile. Accordingly, electric current is not concentrated at corner portions of coil conductors, and hence, the direct-current resistance becomes small. However, the inside diameter of the spiral coil 73 becomes small, and consequently, the inductance becomes small. As a result, the impedance becomes small. In addition, in Comparative Examples 1 and 2, the degree of lamination shift is large.

In contrast, in the first preferred embodiment (the multilayer coil component 11), since the centers of the pads 14*c*, 14*d*, 14*g*, 14*h* and via hole conductors 16*b* and 16*d* are located in the positions spaced toward the outer side of the spiral coil 13 with respect to the center line P in the coil-conductor-width direction in plan view, the inside diameter of the spiral coil 13 becomes large, and hence, the impedance (inductance) becomes large. Also, the amounts of overlap between the coil conductors, and the via hole conductors 16*b* and 16*d* with the pads 14*c*, 14*d*, 14*g* and 14*h* become small in plan view, thereby preventing the conductors being concentrated, and reducing the lamination shift.

In addition, in the multilayer coil component 11, the via hole conductors 16*a* to 16*e* are arranged in a staggered manner in plan view. In particular, the via hole conductors 16*b* and 16*d* are located in the vicinities of diagonal corner portions, while the via hole conductors 16*a*, 16*e*, and 16*b* are arranged substantially in a line, and the via hole conductors 16*c* and 16*d* are arranged substantially in a line. Accordingly, the distance between the via hole conductors 16*b* and 16*c*, and the like, becomes large, thereby preventing the via hole conductors 16*b* and 16*c* from short-circuiting.

While the centers of the pads 14*a* to 14*j* and the centers of the via hole conductors 16*a* to 16*e* are preferably concentrically arranged in the first preferred embodiment, however, these centers may not be concentric. If these centers are concentric, then the conductive paste exhibits a good filling property when being applied to the holes for via hole conductors.

Also, all pads 14*a* to 14*j* and via hole conductors 16*a* to 16*e* may be shifted to positions spaced toward the outer side. Further, in order to further reliably prevent the conductors from being concentrated, the entire via hole conductors 16*a* to 16*e* may be located in positions outside the outer peripheral surface of the spiral coil 13.

Second Preferred Embodiment

Figure 3A:
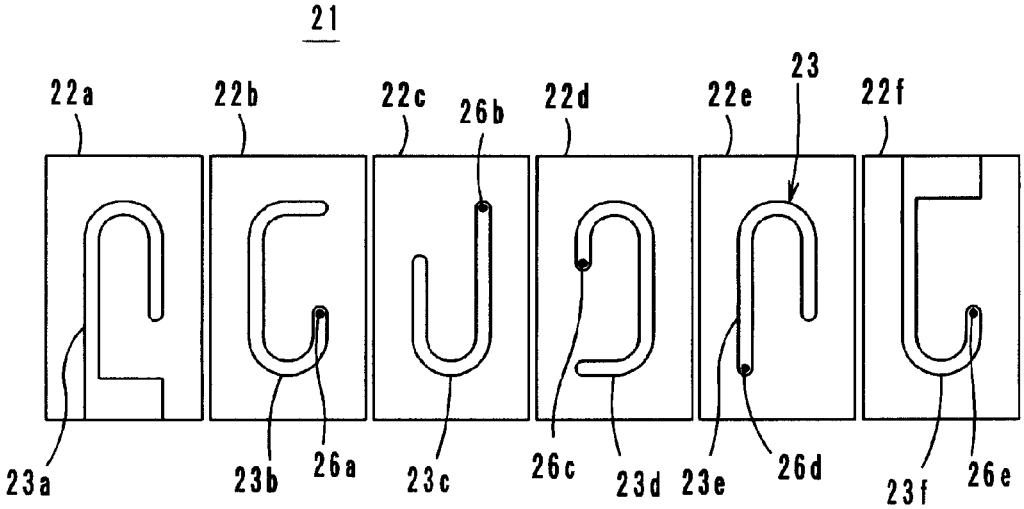
Figure 3B:
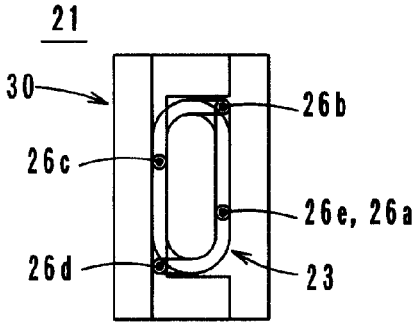

FIGS. 3A and 3B

In a second preferred embodiment, a multilayer coil component with no pad is described. FIG. 3A is an exploded plan view showing a multilayer coil component 21, and FIG. 3B is a perspective plan view showing the multilayer coil component 21. As shown in FIGS. 3A and 3B, the multilayer coil component 21 is formed such that ceramic green sheets 22*a* to 22*f* having coil conductors 23*a* to 23*f* and via hole conductors 26*a* to 26*e* are laminated in the order from the sheet 22*a* to the sheet 22*f*, and then protection ceramic green sheets (not shown) are laminated on the upper and lower sides of the laminated sheets 22*a* to 22*f*.

The multilayer coil component 21 thus obtained has therein a spiral coil 23 which is defined such that the coil conductors 23*a* to 23*f* are electrically connected in series through the via hole conductors 26*a* to 26*e* arranged at end portions of the coil conductors 23*a* to 23*f*. At least the inner periphery of the spiral coil 23 has a curved profile.

The structure and manufacturing method of the second preferred embodiment are similar to those of the first preferred embodiment except that no pad is formed at the end portions of the coil conductors 23*a* to 23*f*. Accordingly, the effects and advantages of the second preferred embodiment are basically similar to those of the first preferred embodiment.

In particular, as shown in FIG. 3B, in plan view in the lamination direction, the centers of the via hole conductors 26*b* and 26*d* are located in positions spaced toward the outer side of the spiral coil 23 with respect to the center in the coil-conductor-width direction. Note that, in plan view, the position spaced toward the outer side is a position located outside the center in the coil-conductor-width direction which are not connected to the corresponding via hole conductors. In particular, the center of the via hole conductor 26*b* is located in the position spaced toward the outer side with respect to the center in the coil-conductor-width direction of the coil conductors 23*a*, and 23*d* to 23*f* which are not connected to the via hole conductor 26*b*. Also, the center of the via hole conductor 26*d* is located in the position spaced toward the outer side with respect to the center in the coil-conductor-width direction of the coil conductors 23*a* to 23*c*, and 23*f* which are not connected to the via hole conductor 26*d*. In plan view, the centers of the via hole conductors 26*b* and 26*d* are located in the positions near end surfaces in a long side direction of a multilayer body 30 with respect to the center in the coil-conductor-width direction.

In addition, a pattern of the end portions of the coil conductors 23*b* to 23*e* connected to the via hole conductors 26*b* and 26*d* is different from a pattern of the coil conductors 23*a* to 23*f* located in a coil axis direction of the spiral coil 23 with respect to the end portions of the coil conductors 23*b* to 23*e*. In particular, the pattern of the end portions of the coil conductors 23*b* and 23*c* connected to the via hole conductor 26*b* preferably has a substantially rectangular profile in the vicinity of the via hole conductor 26*b*. On the other hand, the pattern of the coil conductors 23*d* and 23*e* located in the coil axis direction of the spiral coil 23 with respect to the end portions of the coil conductors 23*b* and 23*c* preferably has a circular or substantially circular profile. As seen in plan view, since the pattern of the coil conductors 23*d* and 23*e* is different from that of the coil conductors 23*b* and 23*c* in the vicinity of the via hole conductor 26*b*, the center of the via hole conductor 26*b* may be located in the position spaced toward the outer side of the spiral coil 23 with respect to the center in the coil-conductor-width direction. Similarly, a pattern of the end portions of the coil conductors 23*d* and 23*e* connected to the via hole conductor 26*d* preferably has a substantially rectangular profile in the vicinity of the via hole conductor 26*d*. On the other hand, a pattern of the coil conductors 23*b* and 23*c* located in the coil axis direction of the spiral coil 23 with respect to the end portions of the coil conductors 23*d* and 23*e* preferably has a circular or substantially circular profile. As seen in plan view, since the pattern of the coil conductors 23*b* and 23*c* is different from that of the coil conductors 23*d* and 23*e* in the vicinity of the via hole conductor 26*d*, the center of the via hole conductor 26*d* may be located in the position spaced toward the outer side of the spiral coil 23 with respect to the center in the coil-conductor-width direction.

A portion of each of the via hole conductors 26*b* and 26*d* is located outside an outer peripheral surface of the spiral coil 23. Note that, in plan view, the outer peripheral surface is an outer peripheral surface of the spiral coil 23 defined by the other coil conductors which are not connected to the corresponding via hole conductors. In particular, an outer peripheral surface of the spiral coil 23 defined by the coil conductors 23*a*, and 23*d* to 23*f* is assigned to the case of the via hole conductor 26*b*, whereas an outer peripheral surface of the spiral coil 23 defined by the coil conductors 23*a* to 23*c*, and 23*f* is assigned to the case of the via hole conductor 26*d*.

Accordingly, by shifting the centers of the via hole conductors 26*b* and 26*d* to the positions spaced toward the outer side of the spiral coil 23 with respect to the center line P in the coil-conductor-width direction, the amounts of overlap between the coil conductors 23*a* to 23*f*, and the via hole conductors 26*b* and 26*d* become small in plan view, thereby preventing the conductors from being concentrated. This prevents stress concentration and lamination shift.

Third Preferred Embodiment

Figure 4A:
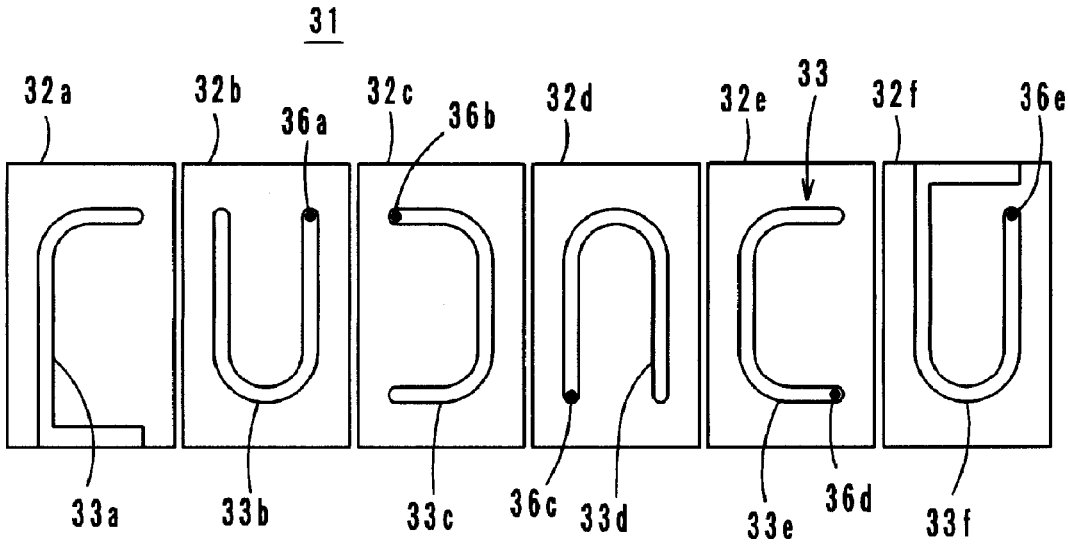
Figure 4B:
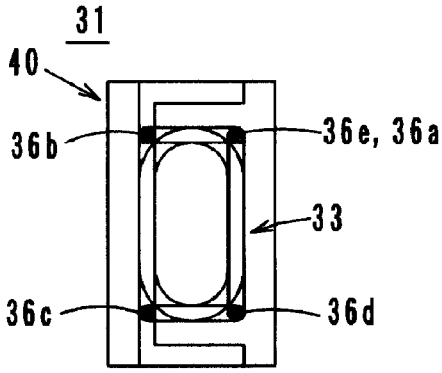

FIGS. 4A and 4B

FIG. 4A is an exploded plan view showing a multilayer coil component 31, and FIG. 4B is a perspective plan view showing the multilayer coil component 31. As shown in FIG. 4A, the multilayer coil component 31 is formed such that ceramic green sheets 32*a* to 32*f* having coil conductors 33*a* to 33*f* and via hole conductors 36*a* to 36*e* are laminated in the order from the sheet 32*a* to the sheet 32*f*, and then protection ceramic green sheets (not shown) are laminated on the upper and lower sides of the laminated sheets 32*a* to 32*f*.

The multilayer coil component 31 thus obtained has therein a spiral coil 33 which is defined such that the coil conductors 33*a* to 33*f* are electrically connected in series through the via hole conductors 36*a* to 36*e* arranged at end portions of the coil conductors 33*a* to 33*f*.

The structure and manufacturing method of the third preferred embodiment are basically similar to those of the first and second preferred embodiments. Accordingly, the effects and advantages of the third preferred embodiment are basically similar to those of the first and second preferred embodiments. The different point is that the coil conductors 33*a* to 33*f* each have a ¾ turn profile. Accordingly, the positions of the via hole conductors 36*a* to 36*e* are widely distributed in four positions, thereby further reliably preventing the conductors from being concentrated. In addition, the number of sheets 32*a* to 32*f* to be laminated may be reduced.

As seen in plan view in the lamination direction, corner portions at the end portions of the coil conductors 33*a* to 33*f* connected to the via hole conductors 36*a* to 36*e* preferably have a substantially rectangular form and corner portions of the coil conductors 33*a* to 33*f* not connected to the via hole conductors 36*a* to 36*e* preferably have a substantially circular form so that the amounts of overlap between the coil conductors 33*a* to 33*f* and the via hole conductors 36*a* to 36*e* are minimized. Accordingly, since the amounts of overlap between the coil conductors 33*a* to 33*f* and the via hole conductors 36*a* to 36*e* are minimized in plan view, the conductors may be prevented from being concentrated, thereby preventing stress concentration and lamination shift.

In other words, in the third preferred embodiment, the entire via hole conductors 36*a* to 36*e* are located in the positions outside the outer peripheral surface of the spiral coil 33. Accordingly, the overlap amount between the via hole conductors 36*a* to 36*e* and the coil conductors 33*a* to 33*f* in the lamination direction is minimized, thereby effectively preventing the conductors from being concentrated. Also, the inside diameter of the spiral coil 33 becomes large, thereby increasing the inductance.

Modifications

The multilayer coil component of the present invention is not limited to that described in each of the above preferred embodiments, and various modifications may be made within the scope of the present invention.

Figure 5A:
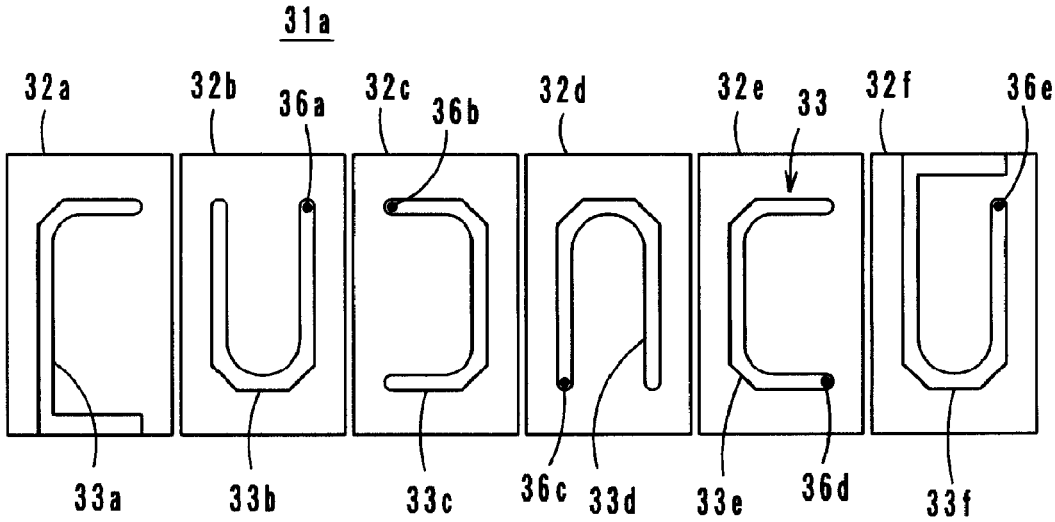
Figure 5B:
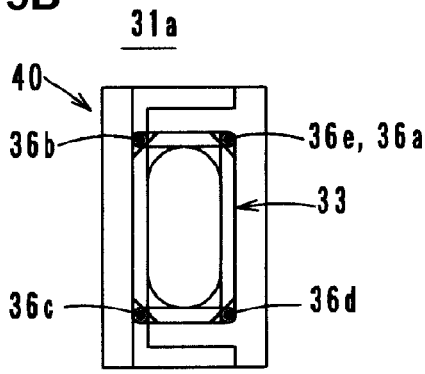

For example, as shown in FIGS. 5A and 5B, the multilayer coil component 31 of the third preferred embodiment may be a multilayer coil component 31*a* including coil conductors 33*a* to 33*f* of which outer periphery at corner portions has an angular profile and inner periphery has a curved profile.

Figure 6A:
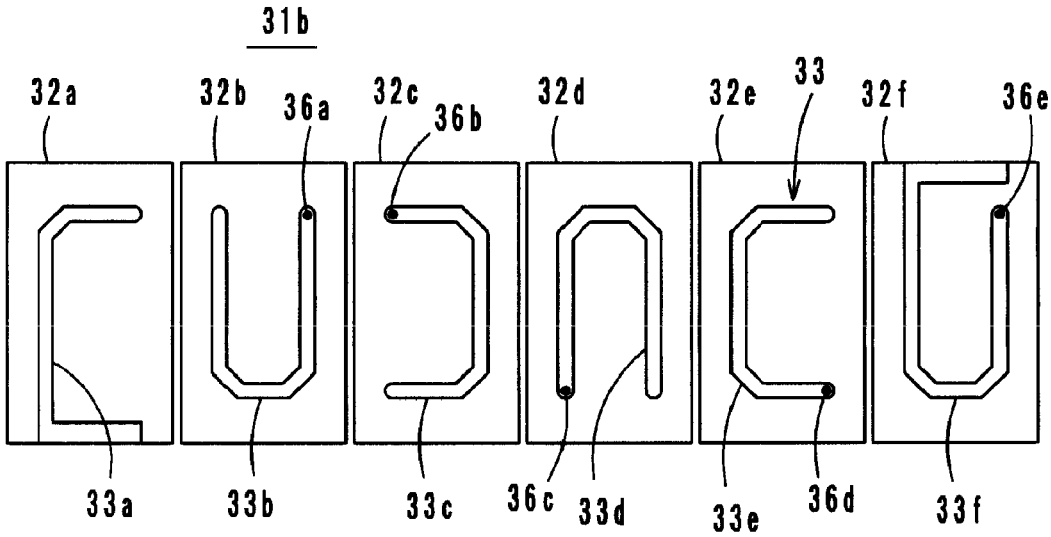
Figure 6B:
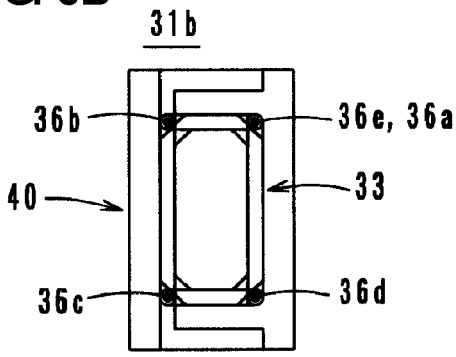
Figure 7A:
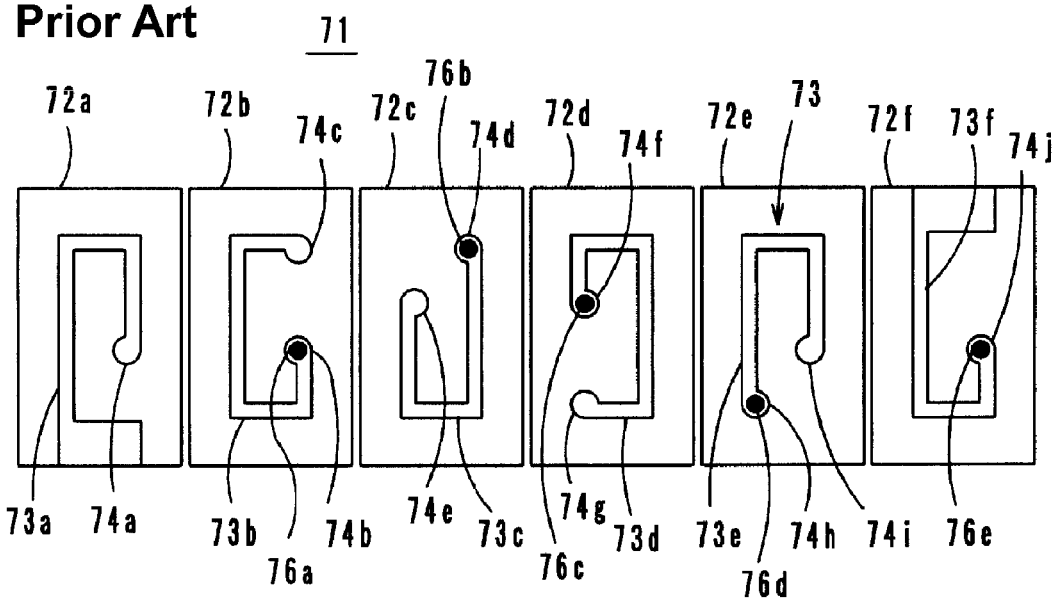
FIG. 7A Prior Art
Figure 7B:
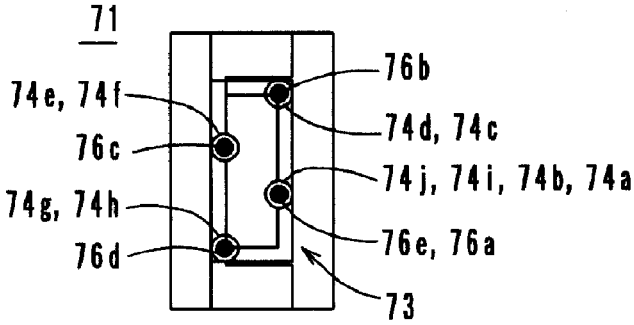
FIG. 7B Prior Art

Alternatively, as shown in FIGS. 6A and 6B, the multilayer coil component 31 of the third preferred embodiment may be a multilayer coil component 31*b* including coil conductors 33*a* to 33*f* of which inner and outer peripheries at corner portions have an angular profile.

While the ceramic sheets are preferably laminated and then fired in the above-described preferred embodiments, the multilayer coil component of the present invention may be manufactured in other ways. The ceramic sheets that have been fired may be used. Also, the multilayer coil component may be manufactured by a method described below. A ceramic layer is formed using ceramic material paste by printing or the like, and then conductive material paste is applied on the surface of the ceramic layer to form a coil conductor. Then, the ceramic material paste is applied thereon, to provide a ceramic layer. By alternately applying the ceramic material paste and the conductive material paste, a multilayer coil component having the multilayer structure may be provided.

As described above, preferred embodiments of the present invention are useful for multilayer coil components having the spiral coil in the multilayer body made of the plurality of ceramic layers. In particular, preferred embodiments of the present invention are excellent in preventing decreases in inductance.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A multilayer coil component comprising:

a multilayer body in which a plurality of coil conductors and a plurality of ceramic layers are laminated in a lamination direction; and a spiral coil in which the plurality of coil conductors are connected in series through a plurality of via hole conductors provided at end portions of the coil conductors; wherein in plan view in the lamination direction, a center of at least one of the via hole conductors is located in a position spaced toward an outer side of the spiral coil with respect to a center in a coil-conductor-width direction;

a pattern of an end portion of a corresponding one of the coil conductors that is connected to the via hole conductor with the center thereof located in the position spaced toward the outer side of the spiral coil with respect to the center in the coil-conductor-width direction is different from a pattern of another one of the coil conductors that is not connected to the via hole conductor and located in a coil axis direction of the spiral coil with respect to the end portion of the corresponding one of the coil conductors; and a portion of the via hole conductor with the center thereof located in the position spaced toward the outer side of the spiral coil with respect to the center in the coil-conductor-width direction is located outside an outer peripheral surface of the spiral coil.

2. The multilayer coil component according to claim 1, wherein, in plan view in the lamination direction, the center of the via hole conductor located in the position spaced toward the outer side of the spiral coil with respect to the center in the coil-conductor-width direction is located in a position near an end surface in a long side direction of the multilayer body with respect to the center in the coil-conductor-width direction.

3. The multilayer coil component according to claim 1, wherein the entire via hole conductor with the center thereof located in the position spaced toward the outer side of the spiral coil with respect to the center in the coil-conductor-width direction is located outside the outer peripheral surface of the spiral coil.

4. The multilayer coil component according to claim 1, wherein the coil conductors each have a ¾ turn profile.

5. The multilayer coil component according to claim 1, wherein at least an inner periphery of the coil conductors has a curved profile.

6. The multilayer coil component according to claim 1, wherein, in plan view in the lamination direction, the via hole conductors are arranged in a staggered manner.

7. A multilayer coil component comprising:

a multilayer body in which a plurality of coil conductors and a plurality of ceramic layers are laminated in a lamination direction; and a spiral coil in which the plurality of coil conductors are connected in series through pads and via hole conductors provided at end portions of the coil conductors; wherein in plan view in the lamination direction, a center of at least one of the via hole conductors and a center of at least one of the pads are located in positions spaced toward an outer side of the spiral coil with respect to a center in a coil-conductor-width direction; and a pattern of an end portion of a corresponding one of the coil conductors that is connected to the via hole conductor with the center thereof located in the position spaced toward the outer side of the spiral coil with respect to the center in the coil-conductor-width direction is different from a pattern of another one of the coil conductors that is not connected to the via hole conductor and located in a coil axis direction of the spiral coil with respect to the end portion of the corresponding one of the coil conductors.

8. The multilayer coil component according to claim 7, wherein a portion of the via hole conductor with the center thereof located in the position spaced toward the outer side of the spiral coil with respect to the center in the coil-conductor-width direction is located outside an outer peripheral surface of the spiral coil.

9. The multilayer coil component according to claim 7, wherein, in plan view in the lamination direction, the center of the via hole conductor and the center of the pad located in the positions spaced toward the outer side of the spiral coil with respect to the center in the coil-conductor-width direction are located in positions near an end surface in a long side direction of the multilayer body with respect to the center in the coil-conductor-width direction.

10. The multilayer coil component according to claim 7, wherein the center of the pad and the center of the via hole are concentrically arranged.

11. The multilayer coil component according to claim 7, wherein the entire via hole conductor with the center thereof located in the position spaced toward the outer side of the spiral coil with respect to the center in the coil-conductor-width direction is located outside the outer peripheral surface of the spiral coil.

12. The multilayer coil component according to claim 7, wherein the coil conductors each have a ¾ turn profile.

13. The multilayer coil component according to claim 7, wherein at least an inner periphery of the coil conductors has a curved profile.

14. The multilayer coil component according to claim 7, wherein, in plan view in the lamination direction, the via hole conductors are arranged in a staggered manner.

* * * * *